US011319176B2

(12) United States Patent
Komuro et al.

(10) Patent No.: US 11,319,176 B2
(45) Date of Patent: May 3, 2022

(54) RECORDING APPARATUS

(71) Applicant: SEIKO EPSON CORPORATION, Tokyo (JP)

(72) Inventors: Shintaro Komuro, Matsumoto (JP); Shingo Waki, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 150 days.

(21) Appl. No.: 16/774,598

(22) Filed: Jan. 28, 2020

(65) Prior Publication Data

US 2020/0239252 A1 Jul. 30, 2020

(30) Foreign Application Priority Data

Jan. 30, 2019 (JP) ..... JP2019-014060

(51) Int. Cl.

| | |
|---|---|
| ***B65H 85/00*** | (2006.01) |
| ***B65H 29/60*** | (2006.01) |
| ***B65H 5/06*** | (2006.01) |
| ***B65H 5/02*** | (2006.01) |
| ***B41J 3/60*** | (2006.01) |

(52) U.S. Cl.

CPC ..... *B65H 5/062* (2013.01); *B41J 3/60* (2013.01); *B65H 5/026* (2013.01); *B65H 85/00* (2013.01); *B65H 2301/33312* (2013.01); *B65H 2801/06* (2013.01)

(58) Field of Classification Search

CPC ..... B65H 2301/33312; B65H 29/125; B65H 29/60; B65H 29/62; B65H 85/00; B65H 2511/528; B65H 5/062; B65H 5/026; B65H 2801/06; B65H 2601/11; B65H 2601/111; B65H 2404/1451

See application file for complete search history.

(56) References Cited

U.S. PATENT DOCUMENTS

| | | | | |
|---|---|---|---|---|
| 2008/0179822 | A1* | 7/2008 | Tu | H04N 1/0058 271/186 |
| 2011/0309564 | A1* | 12/2011 | Samoto | B41J 13/02 271/3.19 |
| 2014/0167346 | A1* | 6/2014 | Iijima | B65H 85/00 271/3.15 |
| 2018/0201031 | A1 | 7/2018 | Okumura | |

FOREIGN PATENT DOCUMENTS

| | | |
|---|---|---|
| JP | 2012-152919 | 8/2012 |

* cited by examiner

*Primary Examiner* — Luis A Gonzalez

(74) *Attorney, Agent, or Firm* — Workman Nydegger

(57) ABSTRACT

A recording apparatus includes a first medium transport path, a reverse path for reversing a surface of a medium, a third medium transport path that guides the medium to the reverse path, a first drive roller configured to rotate in a forward rotation direction that sends the medium toward a discharge port and in a reverse rotation direction opposite to the forward rotation direction, and a second drive roller provided in the third medium transport path and configured to rotate only in the forward rotation direction for sending the medium toward the reverse path, in which a transport force applied to the medium by the first drive roller when the first drive roller rotates in the forward rotation direction is stronger than a transport force applied to the medium by the second drive roller when the second drive roller rotates in the forward rotation direction.

8 Claims, 7 Drawing Sheets

RECORDING APPARATUS

The present application is based on, and claims priority from JP Application Serial Number 2019-014060, filed Jan. 30, 2019, the disclosure of which is hereby incorporated by reference herein in its entirety.

BACKGROUND

1. Technical Field

The present disclosure relates to a recording apparatus that performs recording on a medium.

2. Related Art

Some recording apparatuses as typified by facsimiles, printers, and the like include a path for reversing paper in order to perform recording on both sides of the paper, which is an example of a medium or a sheet. JP-A-2012-152919 discloses a printer including a recording transport path that guides a sheet in a first transport direction, a recording unit that records images on sheets, a reverse transport path that is formed inside the transport path and transports the sheet with an image recorded on one side in a second transport direction and guides the sheet again to the recording unit, and a first roller pair that transports the sheet in the first transport direction or the second transport direction by rotating forward or reverse. A transport roller pair that transports the sheet in the second transport direction is provided in a reverse transport path.

In a recording apparatus, when a jam occurs, return processing may be performed. The return processing is performed, for example, when a user who has received a warning of operation stop due to the occurrence of a jam performs sheet removal processing and then presses an OK button on an operation panel. The return processing includes, for example, an operation of discharging the sheet to the outside of the apparatus assuming that the sheet remains in the apparatus. Here, in the configuration described in JP-A-2012-152919, although the user has removed the sheet in a recording transport path, the return processing may be performed in a state where the sheet remains in a reverse transport path without removing the sheet in the reverse transport path. Accordingly, in the return processing, in consideration of the possibility that the sheet remains in the reverse transport path, a first roller pair may rotate in a sheet discharge direction, that is, a forward rotation direction in order to discharge the sheet stopped in the reverse transport path. However, for example, for the purpose of reducing the cost of the apparatus, the first roller pair and the transport roller pair may be driven by a common motor. In addition, if there is a request to transport a sheet in the first transport direction in the recording transport path while transporting a sheet in the second transport direction in the reverse transport path, that is, to transport two sheets inside the apparatus to improve throughput, even if a sheet feeding direction by the first roller pair is the first transport direction, the sheet feeding direction by the transport roller pair needs to be the second transport direction.

In other words, in order to satisfy the above condition, the transport roller pair provided in the reverse transport path must rotate in the direction in which the sheet is transported in the second transport direction regardless of the rotation direction of the first roller pair. However, when configured in this way, when a sheet is stopped in a state where the sheet is nipped between the transport roller pair and the first roller pair, even if trying to send the sheet in the first transport direction by rotating the first roller forward to discharge the sheet to the outside of the apparatus in the return processing, the transport roller pair tries to send the sheet in the second transport direction, and the sheet cannot be sent in the direction toward the outside of the apparatus, making it difficult to perform appropriate return processing.

SUMMARY

According to an aspect of the present disclosure, there is provided a recording apparatus including a recording unit that performs recording on a medium, a first medium transport path that is a medium transport path facing the recording unit that may transport a medium in a first direction that is a medium transport direction when recording is performed on the medium and in a second direction opposite to the first direction, a reverse path for reversing a surface of the medium, a third medium transport path that is positioned vertically below the first medium transport path and guides the medium on which recording has been performed by the recording unit to the reverse path, a first roller pair that includes a first drive roller that may rotate in a forward rotation direction in which the medium transported in the first direction on the first medium transport path is sent toward a discharge port and in a reverse rotation direction opposite to the forward rotation direction, and a first driven roller that nips the medium with the first drive roller, the first roller pair being positioned between the first medium transport path and the discharge port, discharging the medium from the discharge port by forward rotation of the first drive roller, and sending the medium to the third medium transport path by reverse rotation of the first drive roller, a second drive roller that is provided in the third medium transport path and may rotate only in the forward rotation direction for sending the medium toward the reverse path, and has a common drive source with the first drive roller, and a second roller pair that includes a second driven roller that nips the medium with the second drive roller, in which a transport force applied to the medium by the first roller pair when the first drive roller rotates in the forward rotation direction is stronger than a transport force applied to the medium by the second roller pair when the second drive roller rotates in the forward rotation direction.

DESCRIPTION OF EXEMPLARY EMBODIMENTS

Figure 1:
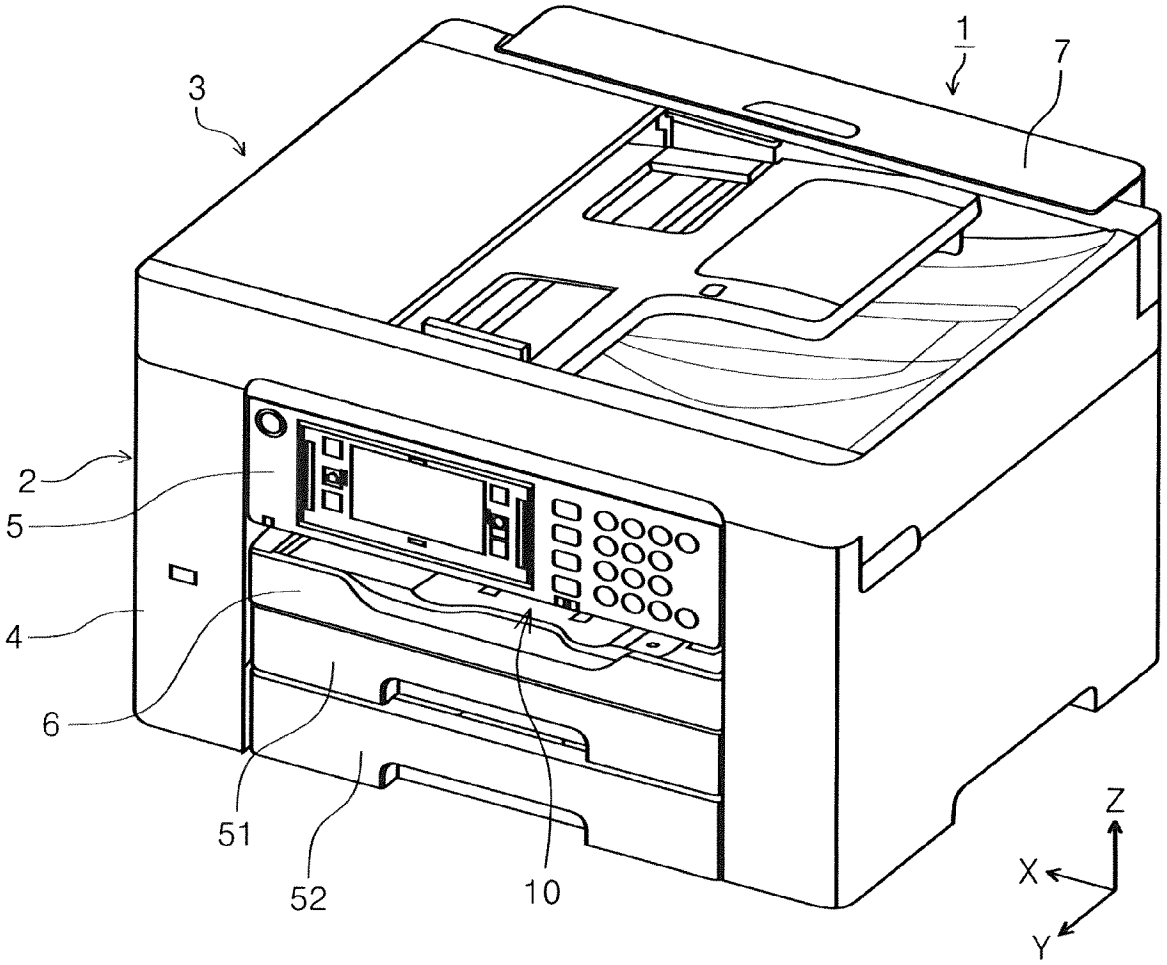
FIG. 1 is a perspective view of a printer as viewed from the front.

The present disclosure will be schematically described below. A recording apparatus according to a first aspect includes a recording unit that performs recording on a medium, a first medium transport path that is a medium transport path facing the recording unit that may transport a medium in a first direction that is a medium transport direction when recording is performed on the medium and in a second direction opposite to the first direction, a reverse path for reversing a surface of the medium, a third medium transport path that is positioned vertically below the first medium transport path and guides the medium on which recording has been performed by the recording unit to the reverse path, a first roller pair that includes a first drive roller that may rotate in a forward rotation direction in which the medium transported in the first direction on the first medium transport path is sent toward a discharge port and in a reverse rotation direction opposite to the forward rotation direction, and a first driven roller that nips the medium with the first drive roller, the first roller pair being positioned between the first medium transport path and the discharge port, discharging the medium from the discharge port by forward rotation of the first drive roller, and sending the medium to the third medium transport path by reverse rotation of the first drive roller, a second roller pair that includes a second drive roller that is provided in the third medium transport path and may rotate only in the forward rotation direction for sending the medium toward the reverse path, and has a common drive source with the first drive roller, and a second driven roller that nips the medium with the second drive roller, in which a transport force applied to the medium by the first roller pair when the first drive roller rotates in the forward rotation direction is stronger than a transport force applied to the medium by the second roller pair when the second drive roller rotates in the forward rotation direction. A second aspect of the present disclosure provides the recording apparatus according to the first aspect, which further includes a second medium transport path that is coupled to the reverse path side of the first transport path and different from the third medium transport path for guiding the medium on which recording has been performed by the recording unit to the reverse path.

In the apparatus, because a transport force applied to the medium by the first roller pair when the first drive roller rotates in the forward rotation direction is stronger than the transport force applied to the medium by the second roller pair when the second drive roller rotates in the forward rotation direction, even if a medium feeding direction by the first roller pair is opposite to a medium feeding direction by the second roller pair when the medium is stopped in a state where the medium is nipped between the first roller pair and the second roller pair, the medium can be sent in the medium feeding direction by the first roller pair, that is, the medium can be sent in the direction toward the discharge port, and appropriate return processing can be executed.

A third aspect of the present disclosure provides the recording apparatus according to the first or second aspect, in which, when the medium is jammed in a state where the medium is nipped between the first roller pair and the second roller pair, the first drive roller is driven in the forward rotation direction.

In the apparatus, when the medium is jammed in a state where the medium is nipped between the first roller pair and the second roller pair, since the first drive roller is driven in the forward rotation direction, the stopped medium can be sent in the direction toward the discharge port, and appropriate return processing can be executed.

A fourth aspect of the present disclosure provides the recording apparatus according to the first or second aspect, in which, when the medium is jammed, the first drive roller is driven in the forward rotation direction regardless of the position where the jam occurs.

In the apparatus, when the medium is jammed, since the first drive roller is driven in the forward rotation direction regardless of the position where the jam occurs, the stopped medium can be sent in the direction toward the discharge port, and appropriate return processing can be executed.

A fifth aspect of the present disclosure provides the recording apparatus according to the first to fourth aspects, in which, a nip force of the medium by the first roller pair is set to be stronger than a nip force of the medium by the second roller pair so that the transport force applied to the medium by the first roller pair when the first drive roller rotates in the forward rotation direction is set stronger than the transport force applied to the medium by the second roller pair when the second drive roller rotates in the forward rotation direction.

In the apparatus, since a nip force of the medium by the first roller pair is set to be stronger than a nip force of the medium by the second roller pair so that the transport force applied to the medium by the first roller pair when the first drive roller rotates in the forward rotation direction is set stronger than the transport force applied to the medium by the second roller pair when the second drive roller rotates in the forward rotation direction, it is possible to easily realize a configuration in which the transport force applied to the medium by the first roller pair is stronger than the transport force applied to the medium by the second roller pair.

A sixth aspect of the present disclosure provides the recording apparatus according to the first to fourth aspects, in which, the frictional force between the first roller pair and the medium is set higher than the frictional force between the second roller pair and the medium so that the transport force applied to the medium by the first roller pair when the first drive roller rotates in the forward rotation direction is set stronger than the transport force applied to the medium by the second roller pair when the second drive roller rotates in the forward rotation direction.

In the apparatus, since a frictional force between the first roller pair and the medium is set higher than the frictional force between the second roller pair and the medium so that the transport force applied to the medium by the first roller pair when the first drive roller rotates in the forward rotation direction is set stronger than the transport force applied to the medium by the second roller pair when the second drive roller rotates in the forward rotation direction, it is possible to easily realize a configuration in which the transport force applied to the medium by the first roller pair is stronger than the transport force applied to the medium by the second roller pair.

A seventh aspect of the present disclosure provides the recording apparatus according to the first to the fourth aspects, in which, a plurality of the first roller pairs and the second roller pairs are provided along a width direction that is a direction intersecting the medium transport direction, and the number of the first roller pairs is larger than the number of the second roller pairs so that the transport force applied to the medium by the first roller pair when the first drive roller rotates in the forward rotation direction is set stronger than the transport force applied to the medium by the second roller pair when the second drive roller rotates in the forward rotation direction.

In the apparatus, since a plurality of the first roller pairs and the second roller pairs are provided along a width direction that is a direction intersecting the medium transport direction, and the number of the first roller pairs is larger than the number of the second roller pairs so that the transport force applied to the medium by the first roller pair when the first drive roller rotates in the forward rotation direction is set stronger than the transport force applied to the medium by the second roller pair when the second drive roller rotates in the forward rotation direction, it is possible to easily realize a configuration in which the transport force applied to the medium by the first roller pair is stronger than the transport force applied to the medium by the second roller pair.

An eighth aspect of the present disclosure provides the recording apparatus according to the first to the fourth aspects, in which, a contact range of the first drive roller to the medium is wider than the contact range of the second drive roller to the medium so that the transport force applied to the medium by the first roller pair when the first drive roller rotates in the forward rotation direction is set stronger than the transport force applied to the medium by the second roller pair when the second drive roller rotates in the forward rotation direction.

In the apparatus, since a contact range of the first drive roller to the medium is wider than the contact range of the second drive roller to the medium so that the transport force applied to the medium by the first roller pair when the first drive roller rotates in the forward rotation direction is set stronger than the transport force applied to the medium by the second roller pair when the second drive roller rotates in the forward rotation direction, it is possible to easily realize a configuration in which the transport force applied to the medium by the first roller pair is stronger than the transport force applied to the medium by the second roller pair. According to ninth aspect of the present disclosure, there is provided a recording apparatus including a recording unit that performs recording on a medium a first medium transport path that is a medium transport path facing the recording unit that may transport a medium in a first direction that is a medium transport direction when recording is performed on the medium and in a second direction opposite to the first direction, a reverse path for reversing a surface of the medium, a third medium transport path that is positioned vertically below the first medium transport path and guides the medium on which recording has been performed by the recording unit to the reverse path, a first roller pair that includes a first drive roller that may rotate in a forward rotation direction in which the medium transported in the first direction on the first medium transport path is sent toward a discharge port and in a reverse rotation direction opposite to the forward rotation direction, and a first driven roller that nips the medium with the first drive roller, the first roller pair being positioned between the first medium transport path and the discharge port, discharging the medium from the discharge port by forward rotation of the first drive roller, and sending the medium to the third medium transport path by reverse rotation of the first drive roller, a second roller pair that includes a second drive roller that is provided in the third medium transport path and may rotate only in the forward rotation direction for sending the medium toward the reverse path, and has a common drive source with the first drive roller, and a second driven roller that nips the medium with the second drive roller, in which in a case where a drive force when the first drive roller rotates in the forward rotation direction and a drive force when the second drive roller rotates in the forward rotation direction are simultaneously applied to one piece of medium, the medium is transported toward the discharge port by the drive force when the first drive roller rotates in the forward rotation direction.

Hereinafter, the present disclosure will be specifically described. In each drawing, the direction along the X axis is the apparatus width direction, which is the direction intersecting a paper transport direction, that is, a paper width direction. The −X direction is the right direction when viewed from a user when the front of the apparatus faces the user, and a +X direction is the left direction. The direction along the Y axis is the apparatus depth direction, and the +Y direction is the direction from the back of the apparatus to the front, which is a first direction. The −Y direction is the direction from the front to the back of the apparatus, which is a second direction. The direction along the Z axis is the vertical direction, the +Z direction is vertically upward, and the −Z direction is vertically downward. In the present embodiment, among the side surfaces that form the periphery of the apparatus, the side surface on which an operation unit 5 is provided is the front surface of the apparatus.

In FIG. 1, an ink jet printer 1 which is an example of a recording apparatus is a so-called multi-function machine including a scanner unit 3 above an apparatus main body 2. Hereinafter, the ink jet printer is abbreviated as "printer". The apparatus main body 2 has a function of recording on recording paper that is an example of a medium, and the scanner unit 3 has a function of reading a document. The scanner unit 3 includes an automatic document feeding mechanism (ADF: Auto Document Feeder) that automatically feeds a set document.

The apparatus main body 2 includes a transport path (described later) for transporting recording paper and a recording head 9 (FIG. 4) as an example of a recording unit, and includes two medium accommodating cassettes, specifically, a first paper cassette 51 and a second paper cassette 52 that are detachable in the embodiment.

The apparatus main body 2 is configured to be able to set and feed a sheet from the back of the apparatus in addition to setting sheets to the first paper cassette 51 and the second paper cassette 52. Reference numeral 7 denotes a cover for opening and closing a paper setting opening (not shown) when setting paper from the back of the apparatus.

The apparatus main body 2 includes the operation unit 5 that performs various operations of the printer 1 on the front surface of the apparatus. The operation unit 5 includes a display unit and a plurality of operation buttons, and is provided so as to be tilted. A discharge port 10 for discharging recording paper on which recording has been performed is provided below the operation unit 5, and a discharge tray 6 for receiving recording paper to be discharged is provided below the discharge port 10. As shown in FIG. 1, the discharge tray 6 is provided so as to be accommodated inside the apparatus main body 2 and to be pulled out from the apparatus main body 2 (not shown).

Figure 2:
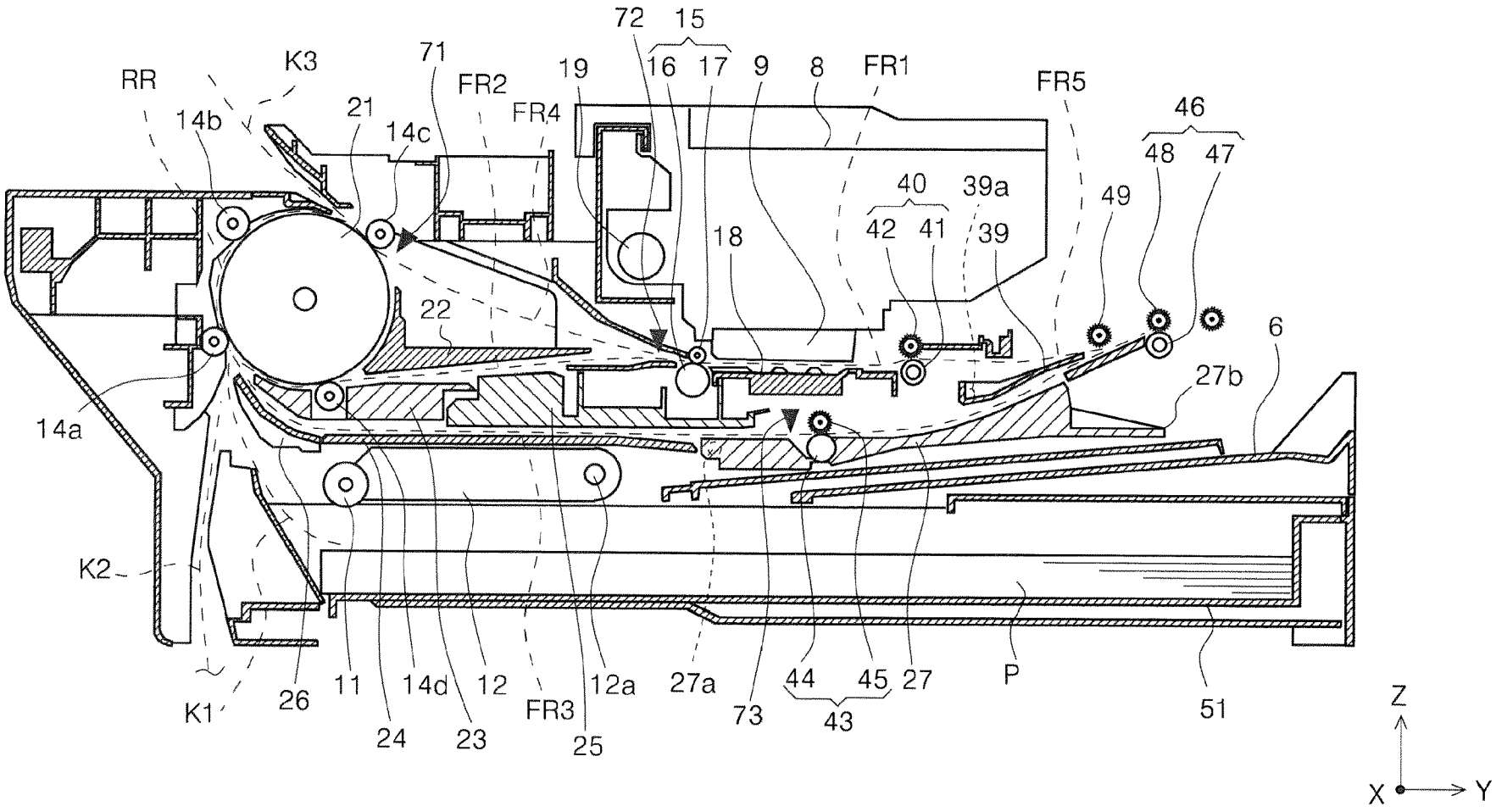
FIG. 2 is a side cross-sectional view showing an entire paper transport path of the printer.

Next, the transport path of the recording paper will be described with reference to FIG. 2. In FIG. 2, the illustration of the second paper cassette 52 is omitted. In the printer 1, regardless of the feeding path, the recording paper is transported to a transport roller pair 15 via a reverse roller 21 constituting a reverse path RR and is transported to the recording area by a recording head 9 by the transport roller pair 15.

More specifically, the printer 1 includes a paper feeding path K1 for feeding recording paper from the first paper cassette 51 as a paper feeding path, a paper feeding path K2 for feeding recording paper from the second paper cassette 52 below the first paper cassette 51, and a paper feeding path K3 for manually feeding recording paper from the upper rear of the apparatus.

The printer 1 also includes a first paper transport path FR1 that can transport the recording paper in a first direction (+Y direction) which is a paper transport path facing the recording head 9 and which is a paper transport direction when recording on the recording paper and in a second direction (−Y direction) opposite to the first direction as a paper transport path, a reverse path RR for reversing the surface of the recording paper, a second paper transport path FR2 for guiding the recording paper on which recording has been performed to the reverse path RR, and a third paper transport path FR3 that is positioned vertically below the second paper transport path FR2 and that guides the recording paper on which recording has been performed to the reversal path RR, which is different from the second paper transport path FR2.

In the embodiment, the first paper transport path FR1 is a paper transport path between the transport roller pair 15 and a first discharge roller pair 40. The second paper transport path FR2 is a paper transport path between the transport roller pair 15 and a driven roller 14*a* via a driven roller 14*d*. The third paper transport path FR3 is a paper transport path between a second discharge roller pair 46 and the driven roller 14*a* via a reverse drive roller 44. The reverse path RR is a paper transport path between the driven roller 14*a* and a driven roller 14*c*. In FIG. 2, reference numeral FR4 denotes a paper transport path (fourth paper transport path) between the driven roller 14*c* and the transport roller pair 15. Reference numeral FR5 denotes a paper transport path (fifth paper transport path) between the first discharge roller pair 40 and the second discharge roller pair 46.

The recording paper is fed by a feeding roller 11 in the paper feeding path K1. The feeding roller 11 is supported by a support member 12 that swings about a swing shaft 12*a*, and the feeding roller 11 advances and retreats with respect to a recording paper P accommodated in the first paper cassette 51 by the swinging support member 12. The second paper cassette 52 (not shown in FIG. 2) provided under the first paper cassette 51 is also provided with a similar feeding mechanism (not shown).

The reverse roller 21 is formed to have the largest diameter as compared with other rollers and reverses the recording paper. The driven rollers 14*a*, 14*b*, 14*c*, and 14*d* is provided around the reverse roller 21. The recording paper fed through the paper feeding paths K1 and K2 is sent to the transport roller pair 15 through the reverse path RR and the fourth paper transport path FR4. The recording paper fed through the paper feeding path K3 is sent to the transport roller pair 15 through the fourth paper transport path FR4.

The recording paper sent along the −Y direction via the second paper transport path FR2 is sent to the transport roller pair 15 via the reverse path RR and the fourth paper transport path FR4. Similarly, the recording paper sent along the −Y direction via the third paper transport path FR3 is sent to the transport roller pair 15 via the reverse path RR and the fourth paper transport path FR4.

The transport roller pair 15 includes a transport drive roller 16 that is rotationally driven and a transport driven roller 17 that is driven to rotate. The recording paper sent to the transport roller pair 15 is nipped by the transport drive roller 16 and the transport driven roller 17 and sent to an area facing the recording head 9, that is, a recording area, and recording is performed.

A carriage 8 provided with the recording head 9 reciprocates in the X-axis direction by receiving power from a carriage drive motor 64 (FIG. 3) while being guided by a carriage guide shaft 19 extending in the X-axis direction. The recording head 9 ejects ink onto the recording paper as the carriage 8 moves.

A support member 18 is provided at a position facing the recording head 9, and recording paper on which recording is performed by the recording head 9 is supported by the support member 18. Downstream of the support member 18 is provided the first discharge roller pair 40 that sends recording paper on which recording has been performed downstream. The first discharge roller pair 40 includes a first discharge drive roller 41 that is rotationally driven and a first discharge driven roller 42 that is driven to rotate. The first discharge drive roller 41 is a rubber roller in the embodiment, and the first discharge driven roller 42 is a spur that makes point contact with the recording paper in the embodiment. The first discharge roller pair 40 is a roller pair that is first positioned downstream of the recording head 9.

The second discharge roller pair 46 is provided downstream of the first discharge roller pair 40. The second discharge roller pair 46 includes a second discharge drive roller 47 that is rotationally driven, and a second discharge driven roller 48 that is driven to rotate. Reference numeral 49 denotes a driven roller that is provided between the first discharge roller pair 40 and the second discharge roller pair 46 and suppresses the floating of the recording paper. The second discharge drive roller 47 is a rubber roller in the embodiment, and the second discharge driven roller 48 and the driven roller 49 are spurs that make point contact with the recording paper in the embodiment. The function of the second discharge roller pair 46 will be described in detail later.

Hereinafter, the second paper transport path FR2, the third paper transport path FR3, and the reverse path RR will be further described. When recording on a second surface of the recording paper on which recording is performed on a first surface thereof, the side opposite to the first surface, the recording paper on which recording has been performed is sent to the reverse path RR. As the paper transport path at that time, either the second paper transport path FR2 or the third paper transport path FR3 can be selected.

The path length of the third paper transport path FR3 is longer than the path length of the second paper transport path FR2, and a control unit 60 (FIG. 3) of the printer 1 has a paper length threshold. When the length of the recording paper exceeds the threshold, the third paper transport path FR3 is selected, and when the length of the recording paper is less than the threshold, the second paper transport path FR2 is selected.

When using the second paper transport path FR2, after the recording on the first surface is completed, the transport drive roller 16, the first discharge drive roller 41, and the second discharge drive roller 47 are reversed. As a result, the recording paper is transported along the −Y direction along the second paper transport path FR2 and reaches the reverse path RR.

When using the third paper transport path FR3, after the recording on the first surface is completed, the paper is transported along the +Y direction until the trailing edge of the paper reaches the driven roller 49, and then the second discharge drive roller 47 is reversed. A flap 39 that can swing around a swing shaft 39*a* is provided upstream of the driven roller 49, and when recording paper is fed to the third paper transport path FR3, the +Y direction end of the flap 39 is raised upward. (FIG. 4). As a result, the recording paper is sent to the third paper transport path FR3 and sent to the reverse path RR. The flap 39 is driven by a flap drive source 75 (FIG. 3) controlled by the control unit 60 (FIG. 3).

A transport roller pair 43 is provided in the third paper transport path FR3. The transport roller pair 43 includes the reverse drive roller 44 that is rotationally driven and a reverse driven roller 45 that is driven to rotate. The reverse drive roller 44 is a rubber roller in the embodiment, and the reverse driven roller 45 is a spur that makes point contact with the recording paper in the embodiment. From the viewpoint of applying a transport force to the recording paper in the third paper sheet transport path FR3, the second discharge roller pair 46 functions as a first roller pair, and the transport roller pair 43 functions as a second roller pair.

The second discharge drive roller 47 constituting the second discharge roller pair 46 functions as a first drive roller that can rotate in the forward rotation direction (clockwise direction in FIG. 2) in which the recording paper transported in the first direction on the first paper transport path FR1 is sent toward the discharge port 10 and in the reverse rotation direction (counterclockwise direction in FIG. 2) opposite to the forward rotation direction, and the second discharge driven roller 48 constituting the second discharge roller pair 46 nips the recording paper with the second discharge drive roller 47. The second discharge roller pair 46 is positioned between the first paper transport path FR1 and the discharge port 10, and discharges the recording paper from the discharge port 10 by the forward rotation of the second discharge drive roller 47 and feeds the recording paper to the third paper transport path FR3 by the reverse rotation of the second discharge drive roller 47.

Figure 3:
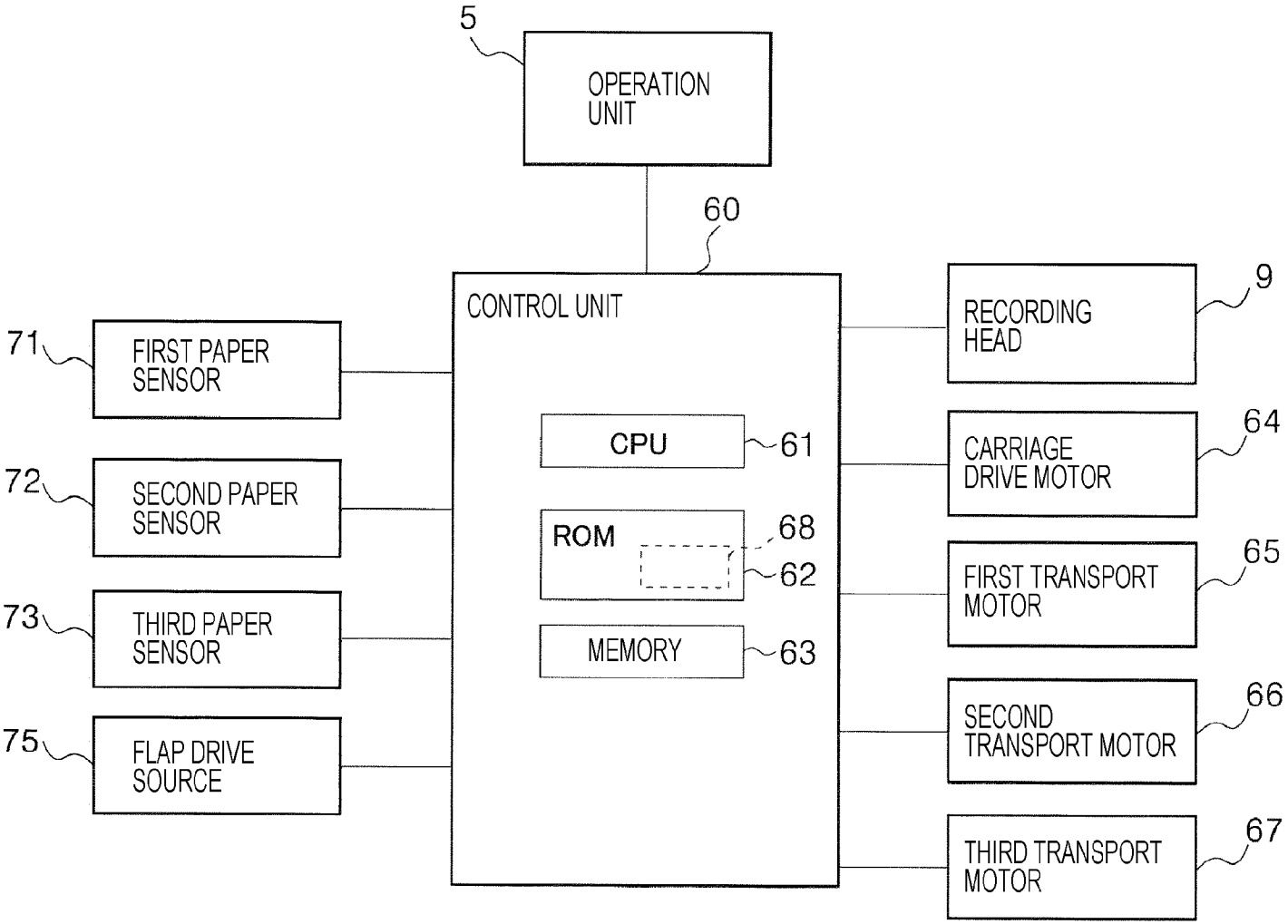
FIG. 3 is a block view showing a control system of the printer.
Figure 4:
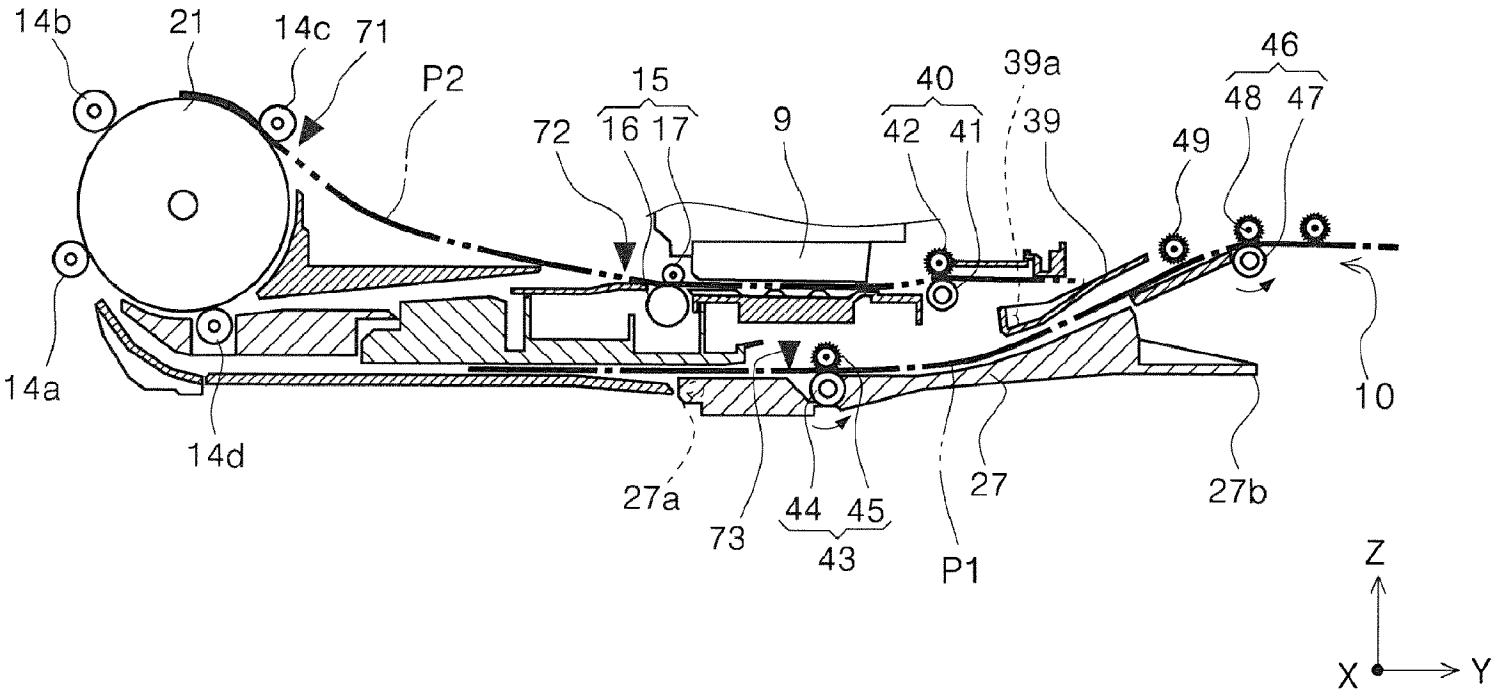
FIG. 4 is a side sectional view showing a part of a paper transport path of a printer.

In the printer 1 having the above paper path, the feeding roller 11 and the reverse roller 21 are driven by a first transport motor 65 (FIG. 3), the transport drive roller 16 and the first discharge drive roller 41 are driven by a second transport motor 66 (FIG. 3), and the second discharge drive roller 47 and the reverse drive roller 44 are driven by a third transport motor 67 (FIG. 3).

A rotation restricting mechanism (not shown) is provided in a power transmission path from the third transport motor 67 to the reverse drive roller 44, and by this rotation restricting mechanism, the reverse drive roller 44 rotates in the direction (counterclockwise direction in FIG. 2) of transporting the recording paper in the −Y direction regardless of the rotation direction of the third transport motor 67. This rotation restricting mechanism can be constituted by a mechanism including a one-way clutch or a mechanism including a planetary gear mechanism, for example. On the other hand, the second discharge drive roller 47 rotates forward when the third transport motor 67 rotates in the forward rotation direction and reverses when the third transport motor 67 rotates in the reverse rotation direction.

Hereinafter, a control system in the printer 1 will be described with reference to FIG. 3. FIG. 3 is a block view showing a control system of the printer 1 according to the present disclosure. In FIG. 3, the control unit 60 as control means performs various other controls of the printer 1 including recording paper feeding control and recording control. A signal from the operation unit 5 is input to the control unit 60, and a signal for realizing display of the operation unit 5, particularly a user interface (UI), is transmitted from the control unit 60 to the operation unit 5.

The control unit 60 controls the carriage drive motor 64, the first transport motor 65, the second transport motor 66, and the third transport motor 67. In the embodiment, these motors are all DC motors. Further, the control unit 60 controls the recording head 9 and the flap drive source 75 described above. Although not shown, the printer 1 includes a sensor that detects the rotation amount of each motor, and the control unit 60 controls each motor based on the detection signal of the sensor.

Detection signals from these detection means of a first paper sensor 71, a second paper sensor 72, and a third paper sensor 73 are also input to the control unit 60, and the control unit 60 performs necessary control based on these detection signals. As shown in FIG. 2, the first paper sensor 71 is a sensor provided near the driven roller 14*c*, the second paper sensor 72 is a sensor provided near the transport roller pair 15, the third paper sensor 73 is a sensor provided near the transport roller pair 43, and each sensor can detect the passage of the leading edge or the trailing edge of the paper at the position where each sensor is disposed. These sensors can be constituted by, for example, reflective or transmissive optical sensors. The control unit 60 can grasp the size of the recording paper being transported in the transport direction, and the leading edge position and the trailing edge position in the sheet transport path based on the detection signal of each paper sensor and the driving amount of each motor, that is, each roller.

The control unit 60 includes a CPU 61, a ROM 62, and a memory 63. The CPU 61 performs various arithmetic processes according to a program 68 stored in the ROM 62 and controls the operation of the entire printer 1. The memory 63 as an example of the storage unit is a non-volatile memory that can be read and written, and the control unit 60 reads necessary data from the memory 63 as the program 68 is executed, and writes necessary data to the memory 63.

Figure 5:
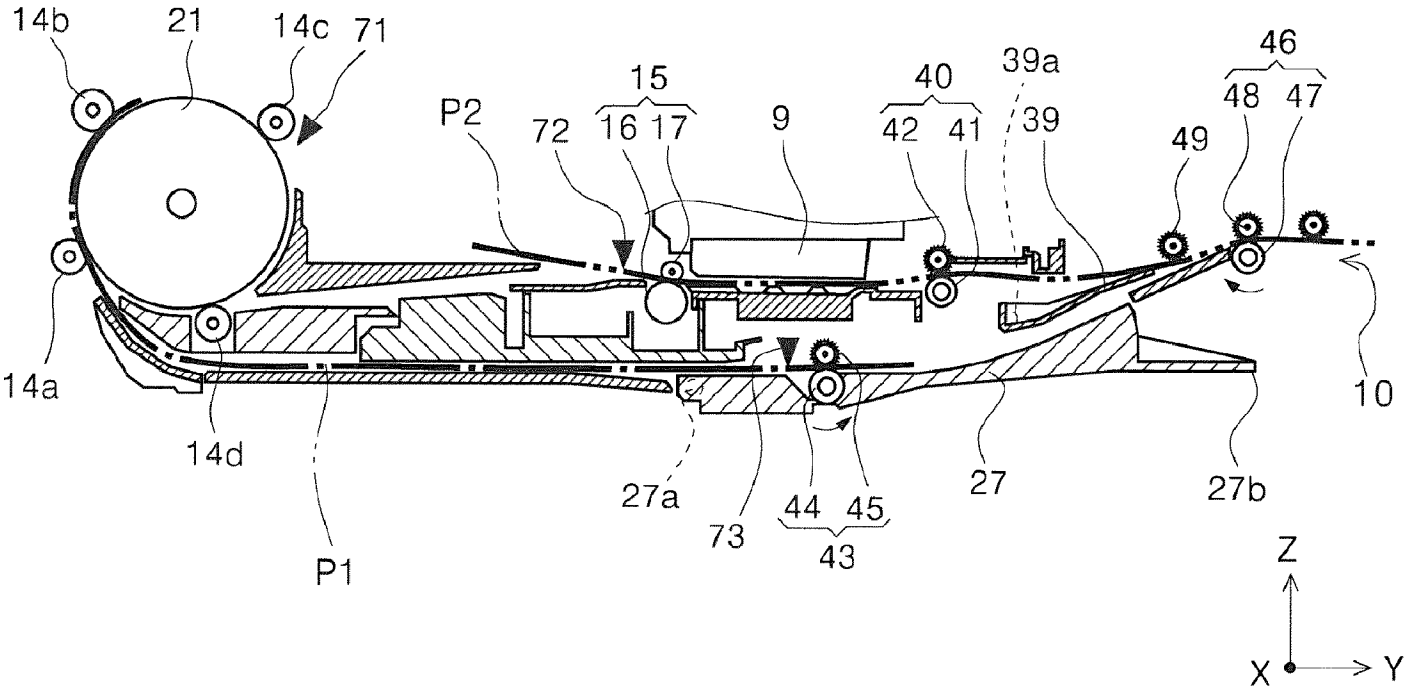
FIG. 5 is a side sectional view showing a part of the paper transport path of the printer.

Next, the operation when a jam occurs will be described with reference to FIG. 4 and later. FIGS. 4 and 5 show only the components necessary for describing the paper transport path. In FIGS. 4 and 5, the alternate long and short dash line indicated by reference numeral P1 indicates preceding paper that has been recorded on the first surface and then sent to the third transport path FR3 to be recorded on the second surface. The two-dot chain line indicated by reference numeral P2 indicates succeeding paper that is fed next to the preceding paper P1 and is being recorded. In the state of FIG. 4, in order to send the preceding paper P1 to the third transport path FR3, the third transport motor 67 (FIG. 3) is reversely rotated, whereby the second discharge drive roller 47 rotates in the counterclockwise direction of FIG. 4. However, as the sheet transport proceeds from this state, the leading edge of the succeeding sheet P2 reaches the second discharge roller pair 46, and therefore the control unit 60 (FIG. 3) switches the third transport motor 67 (FIG. 3) from reverse rotation to forward rotation. As a result, the second discharge drive roller 47 rotates in the clockwise direction as shown in FIG. 5. The control unit 60 (FIG. 3) can determine the timing for switching the third transport motor 67 (FIG. 3) from reverse rotation to forward rotation based on the detection signal of each paper detection sensor and the control amount of each motor.

Next, control when a paper jam occurs will be described with reference to FIG. 6. When it is determined that a paper jam has occurred (step S101), the control unit 60 stops the recording operation (step S102). Stopping the recording operation includes stopping driving of all the motors and stopping ink ejection from the recording head 9. It can be determined that a paper jam has occurred when the detection signal of each paper detection sensor does not change even if the recording paper is transported by a predetermined amount. The recording operation is not limited to the jam of the preceding paper P1 generated in the third transport path FR3. For example, the recording operation is stopped even when the succeeding paper P2 is jammed in another transport path.

Next, the control unit 60 displays an alert indicating that a paper jam has occurred on the operation unit 5 (step S103). This alert display is continued until a release operation is performed by the user (No in step S104). When the alert release operation is performed by the user (Yes in step S104), the control unit 60 performs return processing for causing the third transport motor 67 to rotate forward by a predetermined amount (step S105). This return processing is executed by the control unit 60 when returning from the paper jammed state to the original state. By the return processing in step S105, the second discharge drive roller 47 rotates forward as shown in FIG. 5 and prompts the recording paper to be discharged from the discharge port 10. As a result, even if the user performs an alert release operation without noticing the presence of the recording paper stopped in the third transport path FR3, in the return processing, a transport force is applied so that the recording paper stopped in the third transport path FR3 is discharged from the discharge port 10, and therefore the recording paper stopped in the third transport path FR3 can be discharged from the discharge port 10. When executing the return processing in step S105, the first transport motor 65 drives the reverse roller 21 in the forward rotation direction (clockwise direction in FIG. 4), and the second transport motor 66 drives the transport drive roller 16 and the first discharge drive roller 41 in the forward rotation direction (clockwise direction in FIG. 4).

Here, when the third transport motor 67 is rotated forward, the second discharge drive roller 47 is rotated forward (clockwise direction in FIG. 5), but since the reverse drive roller 44 constituting the transport roller pair 43 rotates so as to transport the recording paper in the opposite direction (counterclockwise direction in FIG. 5), if the recording paper is nipped between the second discharge roller pair 46 and the transport roller pair 43, there is a possibility that the recording paper is pulled by the second discharge roller pair 46 and the transport roller pair 43 and the recording paper cannot be sent in the direction toward the discharge port 10. Therefore, in the embodiment, the transport force applied to the recording paper by the second discharge roller pair 46 when the second discharge drive roller 47 rotates in the forward rotation direction (clockwise direction in FIG. 5) is set to be stronger than the transport force applied to the recording paper by the transport roller pair 43 when the reverse drive roller 44 rotates in the forward rotation direction (counterclockwise direction in FIG. 5). Thus, even when the recording paper is pulled by the second discharge roller pair 46 and the transport roller pair 43, the recording paper can be sent in the direction toward the discharge port 10, and appropriate return processing can be executed.

The control unit 60 (FIG. 3) may perform control so that the second discharge drive roller 47 is driven in the forward rotation direction (clockwise direction in FIG. 5) especially when the recording paper is stopped when the recording paper is nipped by the second discharge roller pair 46 and the transport roller pair 43 or may perform control so that the second discharge drive roller 47 is driven in the forward rotation direction (clockwise direction in FIG. 5) regardless of the position where the recording paper is stopped in the third transport path FR3. In any case, the recording paper stopped in the third transport path FR3 can be sent in the direction toward the discharge port 10, and appropriate return processing can be executed.

Figure 6:
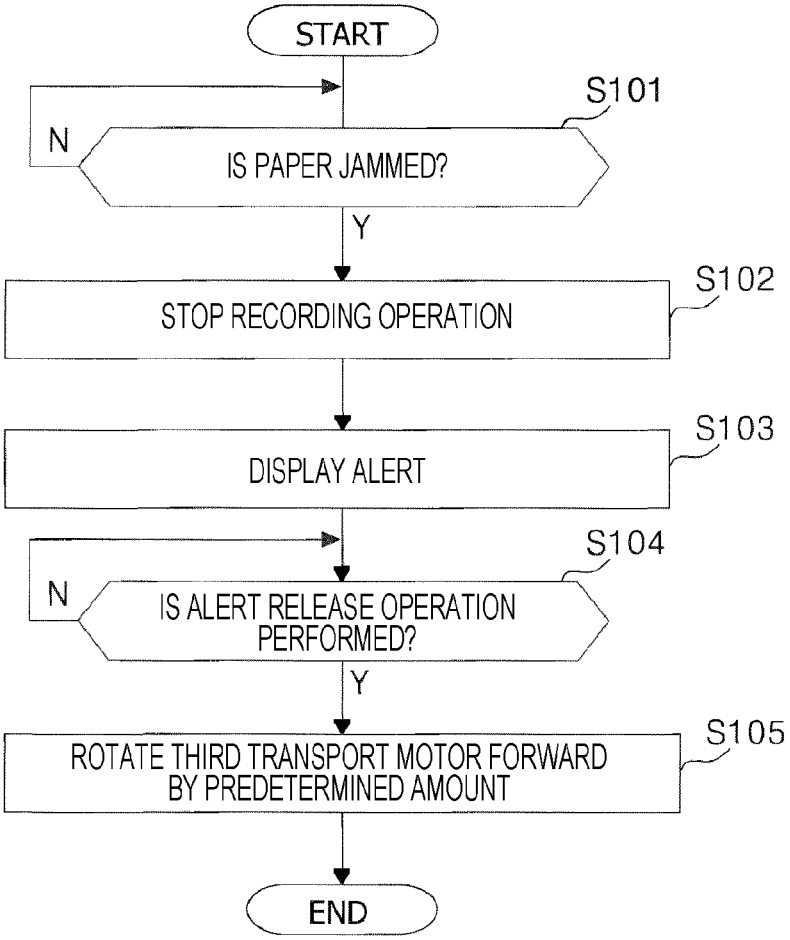
FIG. 6 is a flowchart showing control when a paper jam occurs.

If the recording paper is nipped between the second discharge roller pair 46 and the transport roller pair 43 by the forward rotation drive of the third transport motor 67 in step S105 shown in FIG. 6, that is, the forward rotation drive of the second discharge drive roller 47, the medium is given a transport force toward the discharge port 10. However, when the transport on the third sheet transport path FR3 proceeds and the trailing edge of the paper is removed from the second discharge roller pair 46, the recording paper may be nipped only by the transport roller pair 43. If the third transport motor 67 continues to rotate in the forward rotation direction in this state, the recording paper is sent to the back of the apparatus, that is, in the −Y direction, and it may be difficult to perform appropriate return processing. When a jam occurs and the recording operation is stopped (step S102 in FIG. 6), whether or not the trailing edge of the recording paper that has been sent to the third sheet transport path FR3 and stopped is removed from the second discharge roller pair 46 can be detected by the control unit 60 based on the size of the recording paper and the control amount of the motor. Therefore, when an alert release operation is performed by the user in step S104 in FIG. 6, in a case where the detection signal of the third paper sensor 73 provided near the transport roller pair 43 indicates that there is paper and it can be determined that the trailing edge of the paper is not nipped by the second discharge roller pair 46, the execution of step S105 may be suspended and the alert display may be performed again. Further, the alert display at that time may be a display prompting the user to open a seventh path forming unit 27 and confirm the presence or absence of the recording paper.

Here, the configuration in which the transport force applied to the recording paper by the second discharge roller pair 46 is set stronger than the transport force applied to the recording paper by the transport roller pair 43 can be easily realized as follows. As a first embodiment, the nip force of the recording paper by the transport roller pair 43 is set stronger than the nip force of the recording paper by the second discharge roller pair 46. More specifically, the second discharge driven roller 48 constituting the second discharge roller pair 46 is provided so as to be able to advance and retreat with respect to the second discharge drive roller 47 and is pressed toward the second discharge drive roller 47 by a spring (not shown). Similarly, the reverse driven roller 45 constituting the transport roller pair 43 is provided so as to be able to advance and retreat with respect to the reverse drive roller 44 and is pressed toward the reverse drive roller 44 by a spring (not shown). Therefore, by making the spring force of the spring that presses the second discharge driven roller 48 toward the second discharge drive roller 47 smaller than the spring force of the spring that presses the reverse driven roller 45 toward the reverse drive roller 44, the nip force can be adjusted.

As a second embodiment of the configuration in which the transport force applied to the recording paper by the second discharge roller pair 46 is set stronger than the transport force applied to the recording paper by the transport roller pair 43, the frictional force between the second discharge roller pair 46 and the recording paper is set stronger than the frictional force between the transport roller pair 43 and the recording paper. More specifically, the frictional force between the second discharge drive roller 47 and the recording paper is set stronger than the frictional force between the reverse drive roller 44 and the recording paper. Adjustment of the friction coefficient between each roller and the recording paper can be realized by selection of a material constituting the roller, roller surface treatment, or the like.

Figure 7:
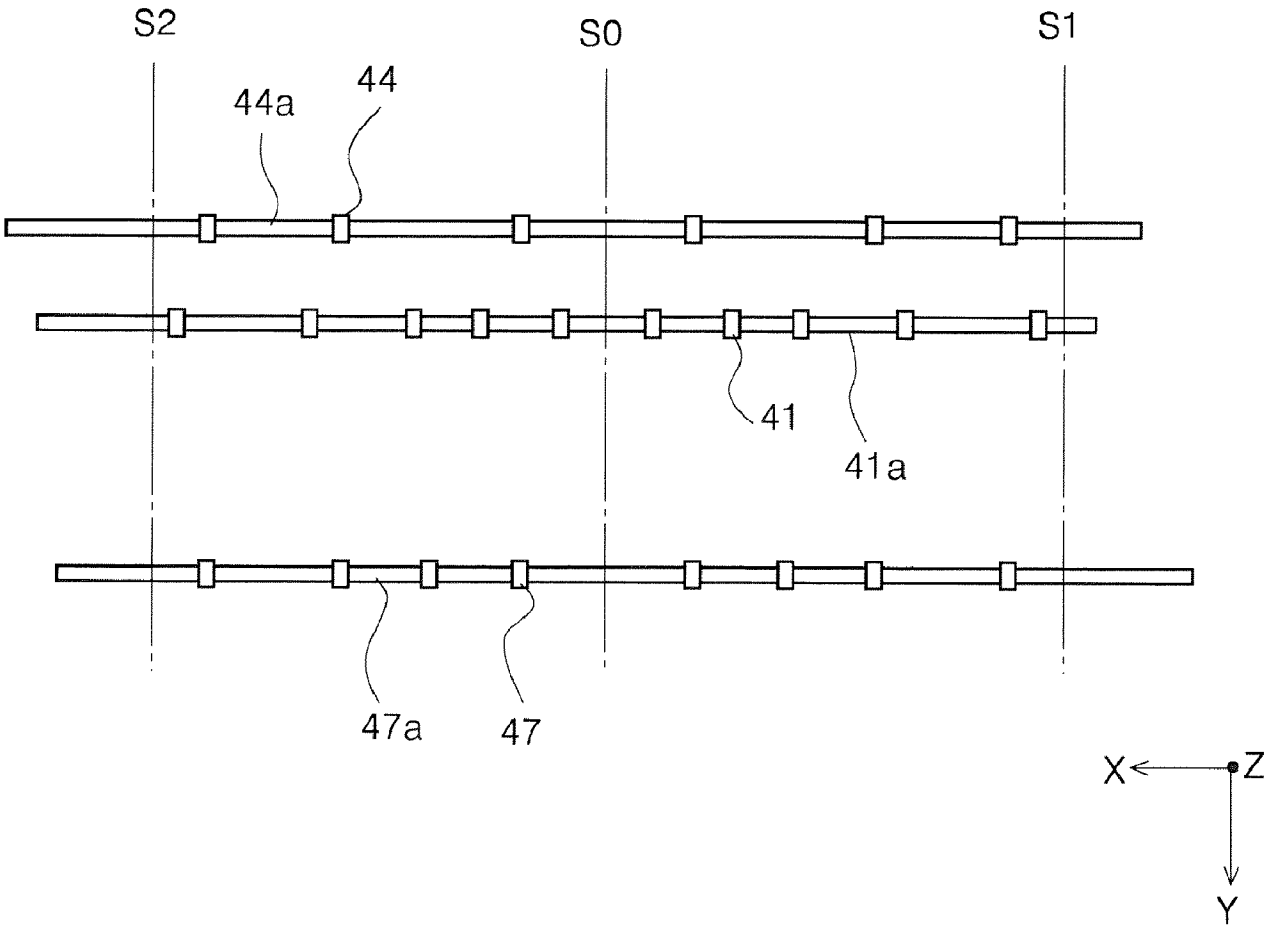
FIG. 7 is a plan view of a first discharge drive roller, a second discharge drive roller, and a reverse drive roller.

As a third embodiment of the configuration in which the transport force applied to the recording paper by the second discharge roller pair 46 is set stronger than the transport force applied to the recording paper by the transport roller pair 43, the number of second discharge roller pairs 46 is set larger than the number of transport roller pairs 43. More specifically, as shown in FIG. 7, a plurality of second discharge drive rollers 47 constituting the second discharge roller pair are provided at an appropriate interval along the X-axis direction with respect to a rotation shaft 47*a*. Similarly, a plurality of first discharge drive rollers 41 are also provided at appropriate intervals along the X-axis direction with respect to a rotation shaft 41*a*. Similarly, a plurality of reverse drive rollers 44 constituting the transport roller pair 43 are provided at an appropriate interval along the X-axis direction with respect to a rotation shaft 44*a*. Therefore, by setting the number of the second discharge drive rollers 47 larger than the number of the reverse drive rollers 44, the transport force applied to the recording paper by the second discharge roller pair 46 can be set stronger than the transport force applied to the recording paper by the transport roller pair 43.

In FIG. 7, a position S1 is the end position in the −X direction of the paper transport area, and a position S2 is the end position in the +X direction of the paper transport area. Setting the number of second discharge drive rollers 47 larger than the number of reverse drive rollers 44 means that the number of second discharge drive rollers 47 is larger than the number of reverse drive rollers 44 between the position S1 and the position S2. A position S0 is a transport reference position and is set at the center in the X-axis direction in the embodiment. Each roller is disposed at a position that is symmetrical with respect to the position S0.

As a fourth embodiment of the configuration in which the transport force applied to the recording paper by the second discharge roller pair 46 is set stronger than the transport force applied to the recording paper by the transport roller pair 43, the contact range of the second discharge drive roller 47 constituting the second discharge roller pair to the recording paper is set wider than the contact range of the reverse drive roller 44 constituting the transport roller pair 43 to the recording paper. Specifically, by bending the paper transport path around the second discharge drive roller 47, the winding angle of the recording paper around the second discharge drive roller 47 is set larger than the winding angle of the recording paper around the reverse drive roller 44. In the embodiment, as shown in FIG. 4, since the paper transport path around the second discharge drive roller 47 is bent, and the paper transport path around the reverse drive roller 44 is linear, the winding angle of the recording paper around the second discharge drive roller 47 is larger than the winding angle of the recording paper around the reverse drive roller 44.

Instead of this, or in addition to this, the contact range of the recording paper with respect to the roller can be adjusted by adjusting the elastic modulus of the roller surface. Specifically, the elastic modulus of the roller surface of the second discharge drive roller 47 is set smaller than the elastic modulus of the roller surface of the reverse drive roller 44. As a result, the outer peripheral surface of the second discharge drive roller 47 is more likely to be crushed than the outer peripheral surface of the reverse drive roller 44, and the contact range with the recording paper increases. Further, the outer diameter of the second discharge drive roller 47 may be larger than the outer diameter of the reverse drive roller 44, and the width of the second discharge drive roller 47 may be larger than the width of the reverse drive roller 44.

The present disclosure is not limited to the embodiments described above, and various modifications are possible within the scope of the disclosure described in the claims, and it is needless to say that the modifications are also included in the scope of the present disclosure.

What is claimed is:

1. A recording apparatus comprising:

a recording unit that performs recording on a medium;

a first medium transport path that is a medium transport path facing the recording unit configured to transport a medium in a first direction that is a medium transport direction when recording is performed on the medium and in a second direction opposite to the first direction;

a reverse path for reversing a surface of the medium;

a second medium transport path that has a first end coupled to the first medium transport path and a second end coupled to the reverse path such that reverse path is between the first and second medium transport paths and the second medium transport path guides the medium on which recording has been performed by the recording unit to the reverse path;

a third medium transport path that is positioned vertically below the first medium transport path and guides the medium on which recording has been performed by the recording unit to the reverse path, the third medium transport path being different from the second medium transport path;

a first roller pair that includes a first drive roller configured to rotate in a forward rotation direction in which the medium transported in the first direction on the first medium transport path is sent toward a discharge port and in a reverse rotation direction opposite to the forward rotation direction, and a first driven roller that nips the medium with the first drive roller, the first roller pair being positioned between the first medium transport path and the discharge port, discharging the medium from the discharge port by forward rotation of the first drive roller, and sending the medium to the third medium transport path by reverse rotation of the first drive roller;

a second roller pair that includes a second drive roller provided in the third medium transport path and configured to rotate only in the forward rotation direction for sending the medium toward the reverse path, and has a common drive source with the first drive roller, and a second driven roller that nips the medium with the second drive roller, wherein a transport force applied to the medium by the first roller pair when the first drive roller rotates in the forward rotation direction is stronger than a transport force applied to the medium by the second roller pair when the second drive roller rotates in the forward rotation direction.

2. The recording apparatus according to claim 1, wherein when the medium is jammed in a state where the medium is nipped between the first roller pair and the second roller pair, the first drive roller is driven in the forward rotation direction.

3. The recording apparatus according to claim 1, wherein when the medium is jammed, the first drive roller is driven in the forward rotation direction regardless of the position where the jam occurs.

4. The recording apparatus according to claim 1, wherein a nip force of the medium by the first roller pair is set to be stronger than a nip force of the medium by the second roller pair so that the transport force applied to the medium by the first roller pair when the first drive roller rotates in the forward rotation direction is set stronger than the transport force applied to the medium by the second roller pair when the second drive roller rotates in the forward rotation direction.

5. The recording apparatus according to claim 1, wherein a frictional force between the first roller pair and the medium is set higher than a frictional force between the second roller pair and the medium so that the transport force applied to the medium by the first roller pair when the first drive roller rotates in the forward rotation direction is set stronger than the transport force applied to the medium by the second roller pair when the second drive roller rotates in the forward rotation direction.

6. The recording apparatus according to claim 1, wherein a plurality of the first roller pairs and the second roller pairs are provided along a width direction that is a direction intersecting the medium transport direction, and the number of the first roller pairs is larger than the number of the second roller pairs so that the transport force applied to the medium by the first roller pair when the first drive roller rotates in the forward rotation direction is set stronger than the transport force applied to the medium by the second roller pair when the second drive roller rotates in the forward rotation direction.

7. The recording apparatus according to claim 1, wherein a contact range of the first drive roller to the medium is wider than a contact range of the second drive roller to the medium so that the transport force applied to the medium by the first roller pair when the first drive roller rotates in the forward rotation direction is set stronger than the transport force applied to the medium by the second roller pair when the second drive roller rotates in the forward rotation direction.

8. A recording apparatus comprising:

a recording unit that performs recording on a medium;

a first medium transport path that is a medium transport path facing the recording unit configured to transport a medium in a first direction that is a medium transport direction when recording is performed on the medium and in a second direction opposite to the first direction;

a reverse path for reversing a surface of the medium;

a second medium transport path that has a first end coupled to the first medium transport path and a second end coupled to the reverse path such that reverse path is between the first and second medium transport paths and the second medium transport path guides the medium on which recording has been performed by the recording unit to the reverse path;

a third medium transport path that is positioned vertically below the first medium transport path and guides the medium on which recording has been performed by the recording unit to the reverse path, the third medium transport path being different from the second medium transport path;

a first roller pair that includes a first drive roller configured to rotate in a forward rotation direction in which the medium transported in the first direction on the first medium transport path is sent toward a discharge port and in a reverse rotation direction opposite to the forward rotation direction, and a first driven roller that nips the medium with the first drive roller;

the first roller pair being positioned between the first medium transport path and the discharge port, discharging the medium from the discharge port by forward rotation of the first drive roller, and sending the medium to the third medium transport path by reverse rotation of the first drive roller;

a second roller pair that includes a second drive roller provided in the third medium transport path and configured to rotate only in the forward rotation direction for sending the medium toward the reverse path, and has a common drive source with the first drive roller, and a second driven roller that nips the medium with the second drive roller, wherein in a case where a drive force when the first drive roller rotates in the forward rotation direction and a drive force when the second drive roller rotates in the forward rotation direction are simultaneously applied to one piece of medium, the medium is transported toward the discharge port by the drive force when the first drive roller rotates in the forward rotation direction.

* * * * *